US006224918B1

(12) United States Patent
Weisenfeld et al.

(10) Patent No.: US 6,224,918 B1
(45) Date of Patent: May 1, 2001

(54) POP-UP NOVELTY PRESENTATION METHOD FOR MICROWAVE FOOD PRODUCT

(76) Inventors: Niel Weisenfeld, 33 Middle La., Westbury, NY (US) 11590; James Slattery, 216 Spratt Ave, Staten Island, NY (US) 10306

( * ) Notice: Subject to any disclaimer, the term of this patent is extended or adjusted under 35 U.S.C. 154(b) by 0 days.

(21) Appl. No.: 09/460,507

(22) Filed: Dec. 14, 1999

(51) Int. Cl.[7] ..... A23L 1/01; A63H 33/00

(52) U.S. Cl. ..... 426/88; 426/104; 426/107; 426/113; 99/342; 99/493; 219/710; 219/720; 446/488

(58) Field of Search ..... 99/342, 493; 426/88, 426/107, 113, 234, 243, 523, 104; 374/122, 149; 219/710, 720, 730; 446/148, 488

(56) References Cited

U.S. PATENT DOCUMENTS

| | | | | |
|---|---|---|---|---|
| D. 268,274 | | 3/1983 | Greenberg | D21/59 |
| 3,768,175 | | 10/1973 | Hill et al. | 35/9 R |
| 4,786,773 | * | 11/1988 | Keefer | 219/10.55 E |
| 4,798,555 | | 1/1989 | Schaub et al. | 446/310 |
| 4,933,525 | * | 6/1990 | St. Phillips | 219/10.55 E |
| 5,022,681 | | 6/1991 | Penick | 281/15.11 |
| 5,069,650 | | 12/1991 | Cehman et al. | 446/476 |
| 5,144,880 | * | 9/1992 | Schmit | 99/342 |
| 5,357,086 | | 10/1994 | Turpin et al. | 219/732 |
| 5,419,730 | | 5/1995 | Diresta et al. | 446/193 |

* cited by examiner

*Primary Examiner*—Keith Hendricks
*Assistant Examiner*—Drew Becker
(74) *Attorney, Agent, or Firm*—OURPAL® Asija

(57) ABSTRACT

This invention relates to the technical field of culinary arts. It includes an amusing way of presenting a novelty item such as a figurine or other promotional or warning message during the heating of a microwave food package which may also serve as a food ready indicator. It may be used as a retrofit to a food package or integrated into a food package.

10 Claims, 3 Drawing Sheets

POP-UP NOVELTY PRESENTATION METHOD FOR MICROWAVE FOOD PRODUCT

BACKGROUND

This invention relates to the technical field of culinary arts and prize or promotional delivery methods.

SUMMARY

In a typical embodiment the pop-up novelty is attached to the food package or otherwise placed in the microwave oven. During the heating process a removable novelty figurine pops up (physically extends out from the food package and maintains such position). Its various embodiments each as a stand alone device, include:

a) As a retrofit to a food package.

b) An integrated device onto a food package.

c) The pop-up item being an indicating message.

d) Permutations and combinations of the above.

PRIOR ART

The prior art of self contained, ready-to-eat, microwave meals does not address presentation of promotional prizes, gifts or novelties in a "pop-up" fashion. Nor does the prior art address "pop-up" presentation of signage or warning or other informational messages.

This invention is a distinct improvement over either the inclusion of promotional items within the meal packaging or placement of signage on the meal packaging. The failure of the industry to incorporate such interesting novelty presentation means, validates the huge market for the microwave pop-up novelty of this invention.

A prior art search was conducted. Following are typical examples of the closest U.S. patent as prior art arranged in the reverse chronological order for ready reference of the reader.

1) U.S. Pat. No. 5,482,158 class 206/217 issued to George Plester of belgium on Jan. 9, 1996 for "Pruomotional Device For Delivering A Prize From a Beverage Can"

2) U.S. Pat. No. 5,419,730 class 446/193 awarded to Diresta et al on May 30, 1995 for "Sounding Toy with Pop Out Action.

3) U.S. Pat. No. 5,357,086 class 219 732 bestowed upon Turpin et al on Oct. 18, 1994 for "Microwave Corn Popping Package"

4) U.S. Pat. No. 5,069,650 class 446/476 earned by Lehmann et al on Dec. 3, 1991 for "Pop Out Toy"

5) U.S. Pat. No. 5,022,681 class 281/15.11 conferred upon Ib Penick on Jun. 11, 1991 for "Paper Pop Up Devices and Method of Making the Same"

6) U.S. Pat. No. 4,798,555 class 446/310 granted to Schaub et al on Jan. 17, 1989 for "Toy Pop Up Figure"

7) U.S. Design Pat. No. D-268,274 class D21/59 given to Sheldon Greenberg on Mar. 15, 1983 for "Multiple Element Pop Up Toy"

8) U.S. Pat. No. 3,768,175 class 35/9R issued to Allen Hill on Oct. 30, 1973 for "Pop Up Learning Toy"

Unfortunately none of the prior art devices singly or even in combination meet all of the objectives established by the inventor for this system as follows.

OBJECTIVES

1. It is an objective of this invention to provide a simple low cost novel method of popping up a novelty or promotional item or a suitable warning when the food is cooked in a microwave oven.

2. Another objective of this invention is that it be suitable for integration into all types microwave-able foods packages.

3. Another objective of this invention is that the popping up of a novelty item such as a figurine also serve as a food ready signal.

4. Another objective of this invention is that it can be retrofitted onto various food packages and used in various microwave ovens conveniently by the DIY (Do-It-Yourself) consumer.

5. Another objective of this invention is that it can be easily incorporated into OEM food packages and used in microwave ovens of all types.

6. Another objective of this invention is that the promotional item be concealed flat by a covering means.

7. Another objective of this invention is that it be safe stable and reliable.

8. Another objective of this invention is that it be ergonomically designed, environmentally friendly and aesthetically integrated with the food package.

9. Another objective of this invention is that it requires no changes in the method of use and operation on the part of the user.

10. Another objective of this invention is that it can be made from a variety of materials.

11. Another objective of this invention is that it meet all federal, state, local and other private standards and regulations with respect to safety, environment, energy consumption, noise etc. etc.

12. Another objective of this invention is that it uses little or no energy.

13. Another objective of this invention is that it not interfere with normal functions of the user.

14. Another objective of this invention is that it be adaptable for other primary and secondary uses without significant modifications.

15. Another objective of this invention is that it can be adapted for used by physically and mentally challenged users.

16. Another objective of this invention is that it combine entertainment with microwave cooking of prepackaged foods.

17. Another objective of this invention is that the microwave sensitive adhesive properties are not lost by aging.

18. Another objective of this invention is that the Pop-up nature of novelty presentation maintain the novelty such as a figurine at a cool temperature relative to the food in the package.

19. Another objective of this invention is that it be able to deliver a prize or novelty item as a stand alone device, placed in a microwave oven, adjacent to any type of food package being heated.

Other objectives of this invention reside in its simplicity, elegance of design, ease of manufacture, service and use and even aesthetics as will become apparent from the following brief description of the drawing and detailed description of the concept.

Prior art patents disclose the general concept of microwave culinary arts but fail to address novelty presentation. The basic concept of pop up toys is also disclosed in the prior art.

The basic concept of popping up a food package in the microwave as an integral part of the food preparation process is also disclosed. But the use of two concepts together is not disclosed especially where the pop up toy or indicator is held by a heat sensitive adhesive instead of a mechanical pressure. Prior art embodiments may also lack the elegance of design of this invention in terms of compact size, fewer component count and fewer moving parts.

BRIEF DESCRIPTION OF THE DRAWING

The objects, features and advantages of the present invention and its application will be more readily appreciated when read in conjunction with the accompanying drawing, in which.

a)

b)

Figure 3A:
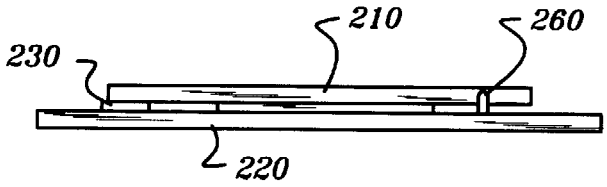
Figure 3B:
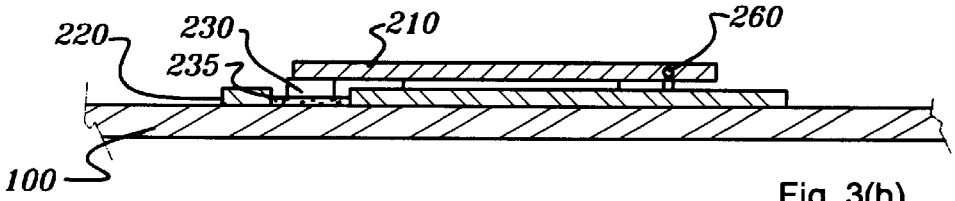
Figure 3C:
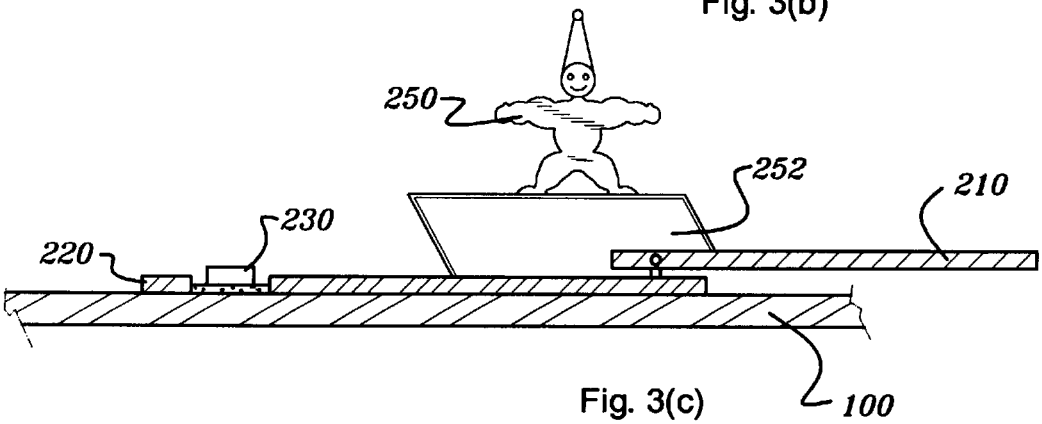
Figure 4A:
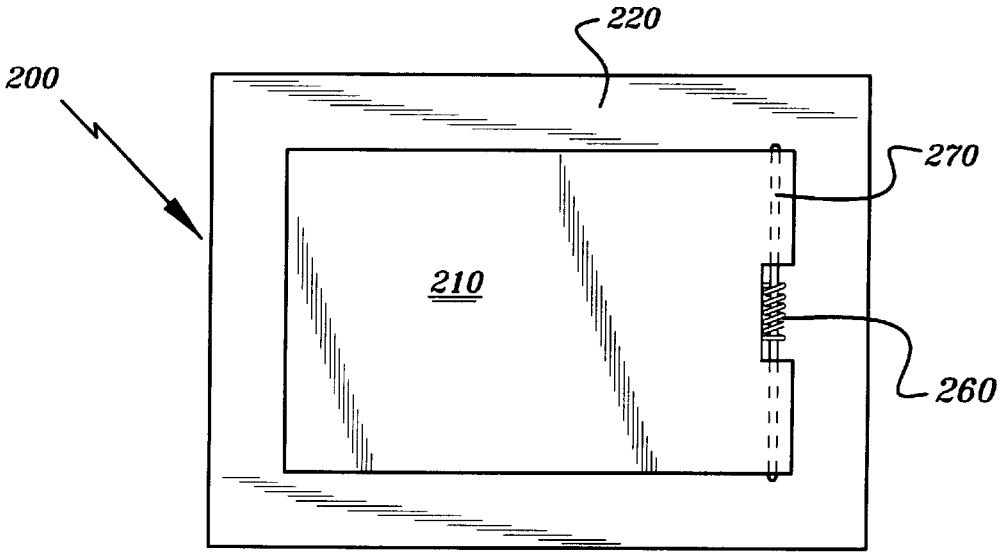
Figure 4B:
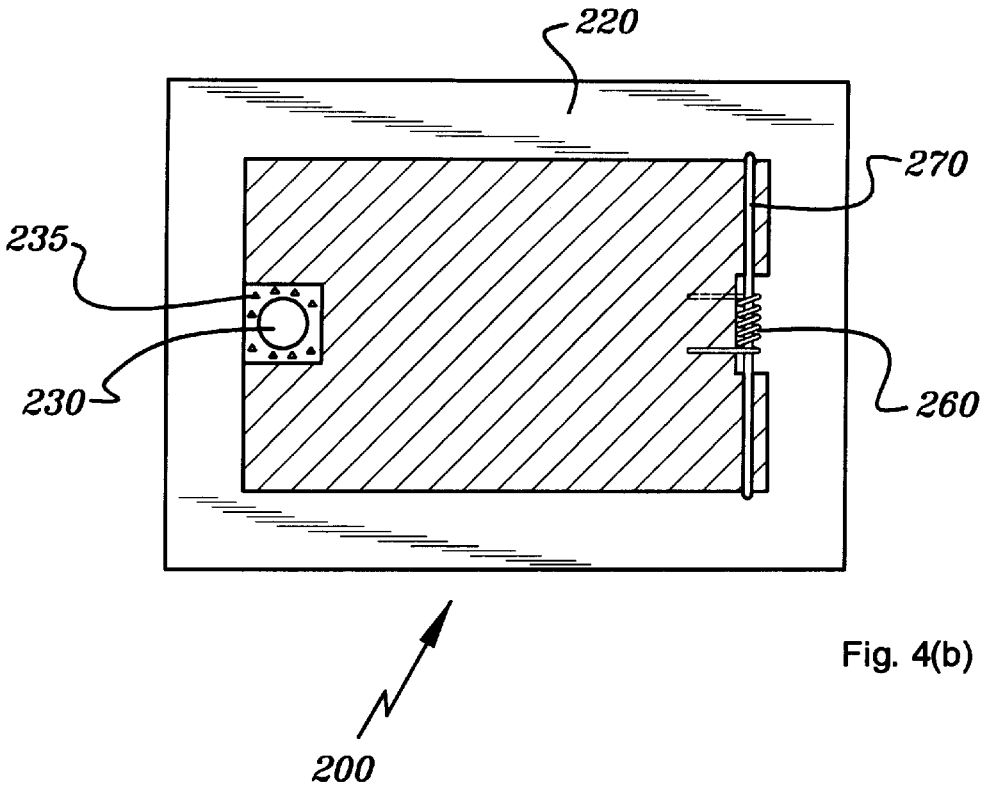
Figure 5:
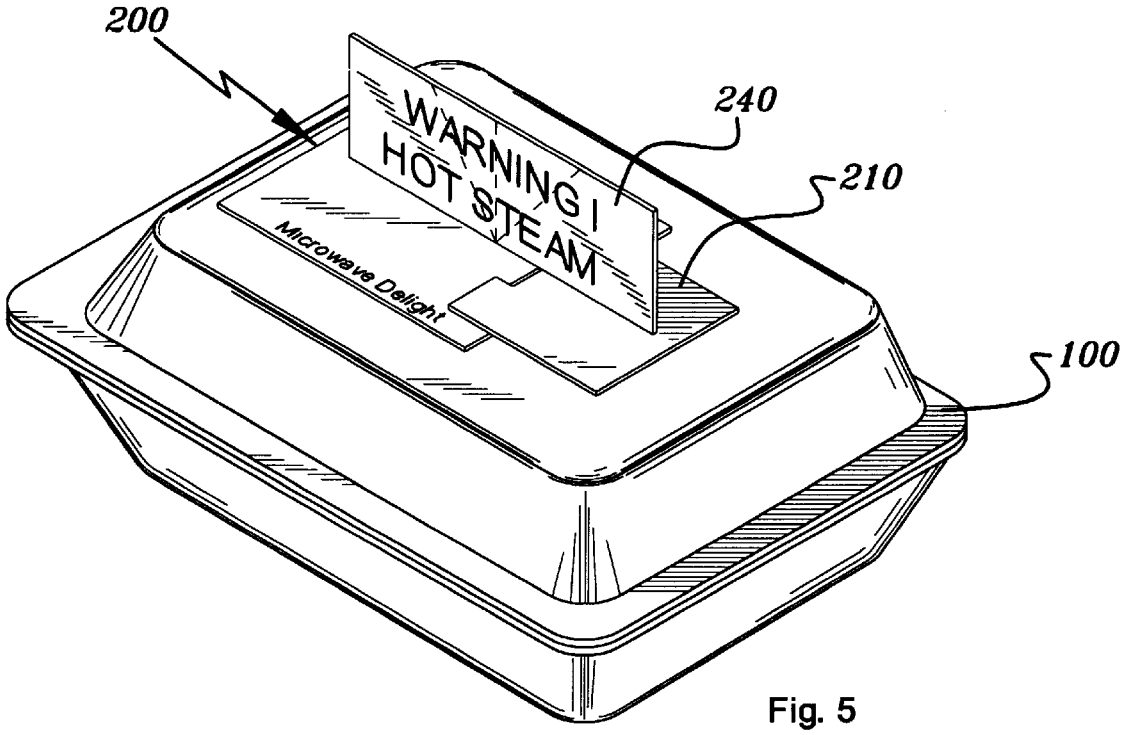

c) FIG. 3(*a*) is a front elevation of the pop-up novelty of this invention without the food package.

d) FIG. 3(*b*) is a front elevation of the pop-up novelty of this invention with the top layer of food package shown.

e) FIG. 3(*c*) is a front elevation of the pop-up novelty of this invention with the figurine in popped up position.

f) FIG. 4(*a*) is a top view of the pop-up novelty in flat unopened position.

g) FIG. 4(*b*) top view of the pop-up novelty in flat unopened position with the pop-up layer removed showing the temperature sensitive adhesive.

h) FIG. 5 is perspective view of the food package with a warning message on top in open or pop-up position.

DETAILED DESCRIPTION OF THE BEST MODE EMBODIMENT

Figure 1:
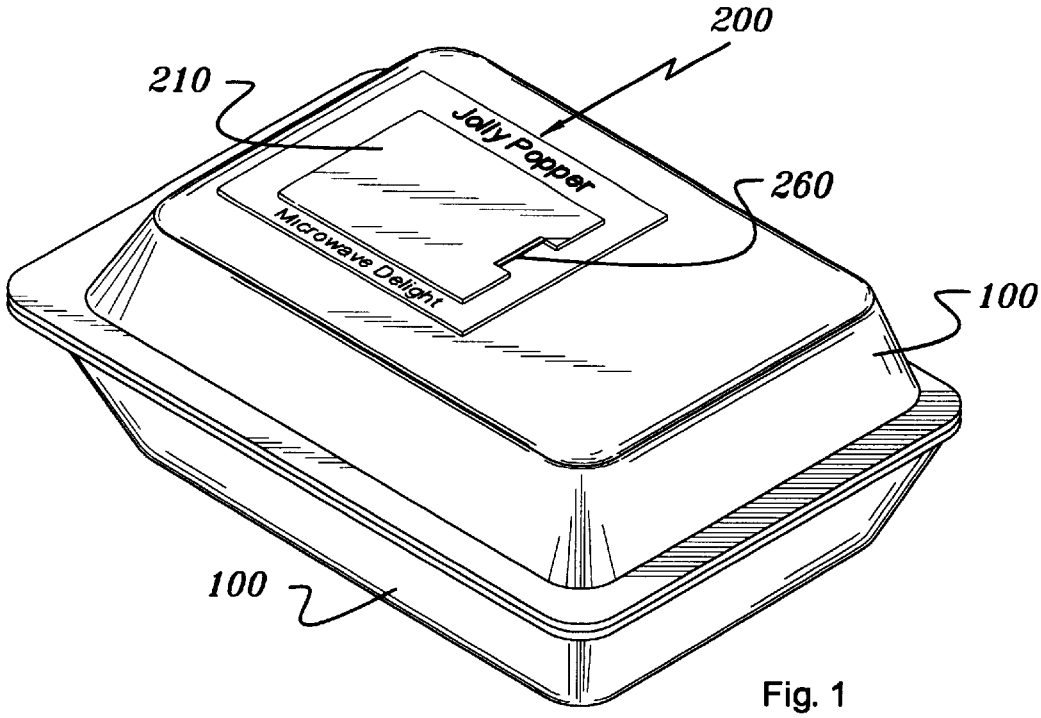
FIG. 1 is a perspective view of the food package with a pop-up novelty flat pack on top in closed position.
Figure 2:
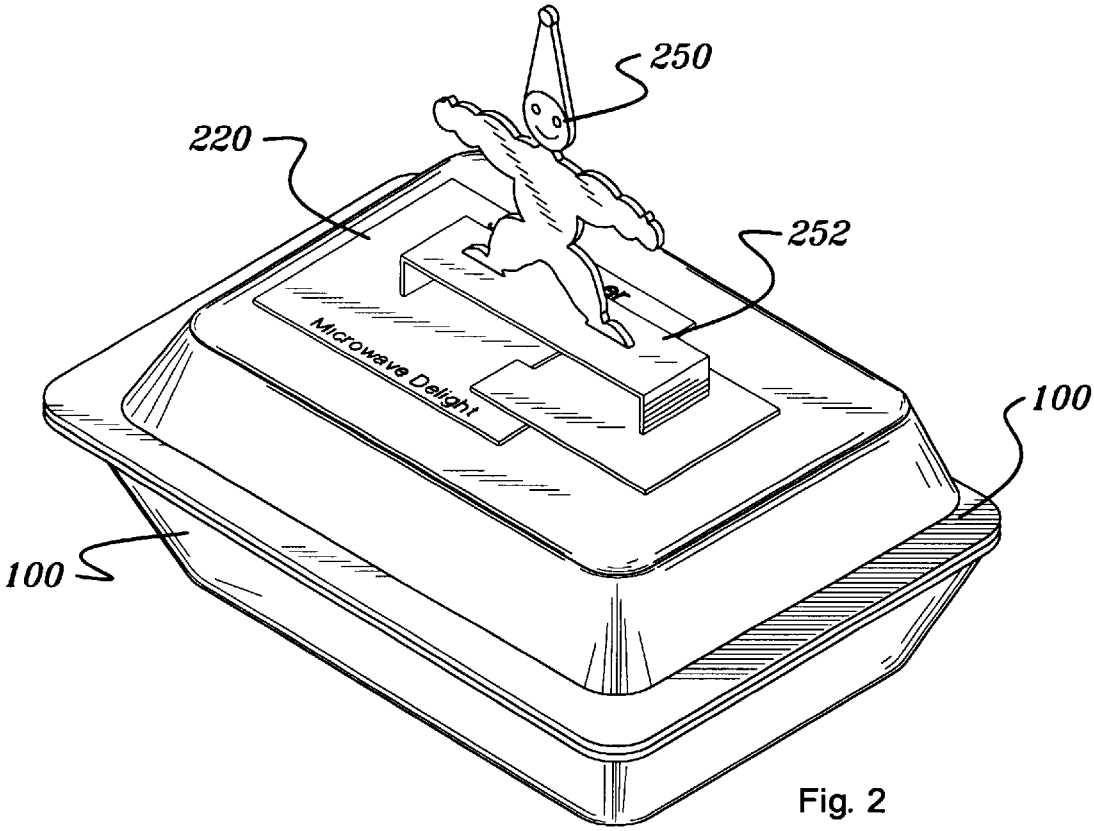
FIG. 2 is a perspective view of the food package with a pop-up novelty on top in open or pop-up position.

As shown in the drawings wherein like numerals represent like parts throughout the several views, there is generally disclosed in FIG. 1 a food package 100 with a pop-up novelty flat pack 200 on top in closed position.

This invention includes methods devices and system for popping up a novelty item such as a removable figurine 250 or a warning message 240 when the food is cooked in a microwave oven. The purpose is to provide an amusing way of presenting a novelty item such as a figurine 250 or other promotional item 240 during the heating of a microwave food package which also serves as a food ready indicator.

An embodiment of this invention comprises a hinged door 210 attached to a base 220 via a pivot rod interface 270. A torsion spring 260 coaxially mounted with the pivot rod is secured to both the door 210 and the base 220 such that when the door 210 is closed the torsion spring is compressed.

A removable novelty or promotional item such as a figurine 250 is mounted via folding interface 252 such that the novelty item stands upright when the door 210 is in the fully open position and lies flat when the door 210 is closed.

The door hides the novelty item 250 until it pops up. The base 220 also includes a temperature sensitive adhesive 230 such as 3M "Jetmelt" 3755-LM and a microwave susceptor material 235 such as AdTech MW-1041.

The device is reusable by placing a self contained removable assembly 3 comprising a flat piece of microwave susceptor material bounded on it's top and bottom by temperature sensitive adhesive.

As the microwave susceptor heats up, due to the microwave energy, the adhesive properties are diminished to below the pop-up spring 260 tension when certain predetermined temperature is achieved.

OPERATION

The door 210 is held closed by a quantity of heat sensitive adhesive 230 or other securing means such as a prefabricated tie or a strap attached to both the door 210 and the base 220. When the entire assembly is processed in the microwave oven regardless of whether it is attached to the food package or placed in the microwave oven alone, the adhesive melts due to the heat generated by the microwave susceptor material allowing the spring to open the door 210 causing the novelty item 250 to stand up and be visible through the window of the MW oven which also serves as a food ready indicator.

The inventor has given a non-limiting description of the concept. Many changes may be made to this design without deviating from the spirit of the concept of this invention. It is the intention of the applicants not only to protect the exact embodiments disclosed by also their equivalents which perform substantially the same function in substantially the same way. Such variations contemplated by the inventors include but are not limited to the following.

1) The invention may be implemented and the figurines may be held flat without a door.

2) Other audio-visual effects may be added such as sound, music, voice, jingle, color, designs etc.

3) Instead of the heat sensitive adhesive a microwave sensitive adhesive tie or strap that looses its adhesive properties when exposed to microwave energy may be employed.

4) Instead of the spring an elastic device such as a rubber band may be employed or other securing means such as a pre-fabricated tie or a strap may be attached to both the door and the base.

5) Instead of the torsion spring the door may be constructed as a bendable structure with inherent rigidity that causes it to open as the adhesive loses its adhesive properties.

6) Holographic visual effects including 3 dimensional virtual reality effects may be added.

7) A different method of pop up may be used with expandable food packages such as pop up corn.

8) A figurine may be filled with a material which expands when subjected to microwave energy which in turn cause the figurine or other promotional item to pop up.

9) Different effects may be combined with rotation of the food package in the microwave oven equipped with a rotating tray.

10) Colors, materials, shapes and design may be changed without deviating from the spirit of this invention.

11) Obvious and even some non-obvious enhancements may be made without deviating from the spirit of this invention.

12) The invention may be adapted more particularly for physically challenged.

13) Complementary functions and affects may be added.

14) An embodiment as a retrofit to a food package for the Do-It-Yourself Consumer may be adapted.

15) An embodiment may be developed for integrating the pop-up novelty of this invention onto a food package.

16) A "Do-It-Yourself" device retrofit-able into a microwave oven may be developed.

17) Permutations and combinations of the above may be implemented to fill market niches.

Other changes such as aesthetic and substitution of newer materials as they become available which substantially perform the same function in substantially the same manner with substantially the same result without deviating from the spirit of this invention may be made.

Following is a listing of the components and procedural steps used in this embodiment arranged in ascending order of the reference numerals for ready reference of the reader.

100—Microwave Food Package.
200—Pop-up novelty generally
210—Pop-up novelty spring door
220—Pop-up novelty base member
230—Temperature sensitive adhesive for the pop up
235=Microwave susceptor material
240—Pop-up warning
250—Pop-up Novelty figurine
252—Pop-up novelty figurine alternate folding interface
260—Pop-up-spring
270—Pivot rod hinged interface

DEFINITIONS

While exacting care has been taken to avoid terms of art and use words with their conventional dictionary meaning the following definitions are included for clarification of the specification and its interpretation.

DIY—Do It yourself

Interface—Matching or two or more dissimilar entities however realized

OEM—Original Equipment Manufacturer

MuW—Microwave (A very high frequency radio wave including a magnetron oscillator adapted for heating by radiation)

Microwave Susceptor Material—A material whose temperature increases when subjected to microwave energy.

While this invention has been described with reference to illustrative embodiments, this description is not intended to be construed in a limiting sense. Various modifications and combinations of the illustrative embodiments as well as other embodiments of the invention will be apparent to a person skilled in the art upon reference to this description. It is therefore contemplated that the appended claims will cover any such modifications, embodiments as fall within the true scope of the invention.

The inventors claim:

1. A microwave culinary arts stand alone device attached to a food package as a means for presentation of a novelty item or message comprising:

a) a base attached to the food package;

b) a door hingedly connected via a pivot rod to said base;

c) a torsion spring coaxially mounted with said pivot rod and is connected to both said door and said base such that when said door is closed said torsion spring is compressed;

d) a removable figurine mounted via a folding interface between said base and said door; and e) a temperature sensitive adhesive and microwave susceptor material between said door and said base.

2. The microwave culinary arts device attached to a food package as a means for presentation of a novelty item or message of claim 1 wherein said temperature sensitive adhesive loses its adhesion properties when the microwave susceptor material reaches a predetermined temperature such that said spring pops open said door thereby releasing said figurine.

3. The microwave culinary arts device attached to a food package as a means for presentation of a novelty item or message of claim 1 wherein said temperature is adjustable as a function of the microwave susceptor material and the temperature sensitive adhesive.

4. The microwave culinary arts device attached to a food package as a means for presentation of a novelty item or message of claim 1 wherein said device is reusable by placing a double sided pallet of temperature sensitive adhesive and a microwave susceptor material between said door and said base after collapsing said figure via said folding interface.

5. A microwave culinary arts stand alone device placed in a microwave oven as a means for presentation of a novelty item or message comprising:

a) a base;

b) a pivot rod connected to said base;

c) a door hingedly connected via said pivot rod to said base;

d) a torsion spring coaxially mounted with said pivot rod and is connected to both said door and said base such that when said door is closed said torsion spring is compressed;

e) a removable pop up novelty item via a folding interface between said base and said door; and f) a temperature sensitive adhesive and a microwave susceptor material between said door and said base.

6. The microwave culinary arts device placed in a microwave oven as a means for presentation of a novelty item or message of claim 5 wherein said temperature sensitive adhesive loses its adhesion properties when a predetermined temperature of the microwave susceptor material is reached such that said spring pops open said door thereby releasing said pop up novelty item.

7. The microwave culinary arts device placed in a microwave oven as a means for presentation of a novelty item or message of claim 5 wherein said temperature is adjustable as a function of the microwave susceptor material and the temperature sensitive adhesive.

8. The microwave culinary arts device placed in a microwave oven as a means for presentation of a novelty item or message of claim 5 wherein said device is reusable by placing a double sided pallet of temperature sensitive adhesive and a microwave susceptor material between said door and said base after collapsing said novelty item via said folding interface.

9. The microwave culinary arts device placed in a microwave oven as a means for presentation of a novelty item or message of claim 5 wherein said novelty item is a figurine.

10. The microwave culinary arts device placed in a microwave oven as a means for presentation of a novelty item or message of claim 5 wherein said novelty item is a warning message.

* * * * *